US012622559B2

(12) United States Patent
Yan et al.

(10) Patent No.: US 12,622,559 B2
(45) Date of Patent: May 12, 2026

(54) CLEANING DEVICE, CONTROL METHOD THEREFOR, AND COMPUTER READABLE STORAGE MEDIUM

(71) Applicant: Beijing Roborock Technology Co., Ltd., Changping District (CN)

(72) Inventors: Chengzhi Yan, Changping District (CN); Haiqiang Zhao, Changping District (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 205 days.

(21) Appl. No.: 18/552,429

(22) PCT Filed: Aug. 19, 2021

(86) PCT No.: PCT/CN2021/113642

§ 371 (c)(1),
(2) Date: Sep. 25, 2023

(87) PCT Pub. No.: WO2022/198910

PCT Pub. Date: Sep. 29, 2022

(65) Prior Publication Data

US 2024/0172910 A1 May 30, 2024

(30) Foreign Application Priority Data

Mar. 26, 2021 (CN) ..... 202110323643.X

(51) Int. Cl.
*A47L 11/40* (2006.01)
*A47L 11/28* (2006.01)

(52) U.S. Cl.
CPC ..... *A47L 11/4008* (2013.01); *A47L 11/28* (2013.01); *A47L 11/4011* (2013.01); *A47L 11/4083* (2013.01); *A47L 11/4088* (2013.01)

(58) Field of Classification Search
None
See application file for complete search history.

(56) References Cited

U.S. PATENT DOCUMENTS

| | | | | |
|---|---|---|---|---|
| 3,774,261 | A | 11/1973 | Colt | |
| 2007/0192973 | A1 | 8/2007 | Eklund et al. | |
| 2022/0338695 | A1 * | 10/2022 | Zhou | A47L 11/4011 |

FOREIGN PATENT DOCUMENTS

| | | | |
|---|---|---|---|
| CN | 103083753 | A | 5/2013 |
| CN | 108344468 | A | 7/2018 |
| CN | 108759977 | A | 11/2018 |
| CN | 209387096 | U | 9/2019 |
| CN | 110507253 | A | 11/2019 |
| CN | 111358380 | A | 7/2020 |
| CN | 111360014 | A | 7/2020 |

(Continued)

OTHER PUBLICATIONS

Extended European Search Report dated Mar. 5, 2025, issued in corresponding European Patent Application No. 21932522.2.

(Continued)

*Primary Examiner* — Kaj K Olsen
*Assistant Examiner* — Pradhuman Parihar
(74) *Attorney, Agent, or Firm* — Morgan, Lewis & Bockius LLP

(57) ABSTRACT

The present disclosure relates to a cleaning device, a control method therefor, and a computer readable storage medium.

3 Claims, 4 Drawing Sheets

(56) References Cited

FOREIGN PATENT DOCUMENTS

| | | | | |
|---|---|---|---|---|
| CN | 112890708 | A | 6/2021 | |
| CN | 216797561 | U | 6/2022 | |
| EP | 3246671 | A1 | 11/2017 | |
| FR | 3108290 | A1 | 9/2021 | |
| WO | WO-2021042861 | A1 * | 3/2021 | ..... A47L 11/28 |

OTHER PUBLICATIONS

Office Action issued in corresponding Chinese Patent Application No. 202110323643.X, dated Nov. 29, 2024.
International Search Report and dated Jan. 6, 2022, issued in related International Patent Application No. PCT/CN2021/113642.

* cited by examiner

CLEANING DEVICE, CONTROL METHOD THEREFOR, AND COMPUTER READABLE STORAGE MEDIUM

CROSS-REFERENCE TO RELATED APPLICATION

The present application is a 35 U.S.C. 371 national phase application of PCT International Application No. PCT/CN2021/113642, filed on Aug. 19, 2021, which claims priority to Chinese Patent Application No. 202110323643.X, filed on Mar. 26, 2021, both of which are incorporated herein by reference in their entireties as a part of the present application.

TECHNICAL FIELD

The present disclosure relates to the field of intelligent detection, and in particular, to a cleaning device and a control method thereof, and a computer-readable storage medium.

BACKGROUND

At present, some cleaning devices on the market have functions of wet mopping and floor scrubbing, which inevitably requires water tanks to be installed on the cleaning devices. The water tanks are possibly short of water or have no water during use.

SUMMARY

In a first aspect, embodiments of the present disclosure provide a cleaning device, including:

- a fluid storage apparatus for storing a fluid;
- a fluid output line communicated with the fluid storage apparatus;
- a fluid detection apparatus, the fluid detection apparatus being disposed at least partially outside the fluid output line and being used for detecting whether there is a fluid in the fluid output line; and
- a control apparatus, the control apparatus being electrically connected to the fluid detection apparatus, and used for outputting a corresponding control instruction according to a detection result of the fluid detection apparatus, and the detection result including a fluid-present state and a fluid-absent state.

In a second aspect, embodiments of the present disclosure provide a control method of a cleaning device. The cleaning device includes a fluid storage apparatus, a fluid output line communicated with the fluid storage apparatus, a fluid detection apparatus disposed outside the fluid output line, and a control apparatus electrically connected to the fluid detection apparatus. The method includes:

- detecting, by the fluid detection apparatus, whether there is a fluid in the fluid output line; and
- outputting, by the control apparatus, a corresponding control instruction according to a detection result of the fluid detection apparatus, so as to control the cleaning device accordingly, the detection result including a fluid-present state and a fluid-absent state.

In a third aspect, embodiments of the present disclosure provide a computer-readable storage medium, storing computer program instructions thereon, wherein the computer program instructions, when executed by a processor, implement the above control method of the cleaning device.

BRIEF DESCRIPTION OF THE DRAWINGS

The following drawings of the present disclosure are incorporated herein as a part of the embodiments of the present disclosure for understanding of the present disclosure. The drawings illustrate the embodiments of the present disclosure and descriptions thereof to explain principles of the present disclosure.

In the drawings.

REFERENCE SIGNS

1—fluid storage apparatus, 2—fluid output line, 3—fluid distribution apparatus, 4—contact sensor, 401—second processing circuit, 402—electrical conductor, 403—electrode, 4031—positive electrode, 4032—negative electrode, 5—non-contact sensor, 501—sensing part, 502—first processing circuit, 6—main body, 7—cleaning head, and 8—handle.

DETAILED DESCRIPTION

In the following description, a large number of specific details are provided to understand the present disclosure more thoroughly. However, it is apparent to those skilled in the art that the present disclosure may be implemented without one or more of these details. In other examples, some of the technical features well known in the art are not described in order to avoid the confusion with the present disclosure.

It should be noted that the terms used herein are merely used to describe particular embodiments and are not intended to limit exemplary embodiments of the present disclosure. As used herein, the singular forms are also intended to include the plural forms unless the context clearly indicates otherwise. In addition, it should also be understood that when the terms "contain" and/or "include" are used in the description, they indicate the presence of the features, wholes, steps, operations, elements and/or components, but do not exclude the presence or addition of one or more other features, wholes, steps, operations, elements, components and/or combinations thereof.

Now, the exemplary embodiments according to the present disclosure will be described in more detail with reference to the drawings. These exemplary embodiments may, however, be implemented in many different forms and should not be construed as being limited to the embodiments set forth herein. It should be understood that these embodiments are provided to enable the present disclosure to be disclosed more thoroughly and completely, and to fully communicate concepts of these exemplary embodiments to those skilled in the art.

The embodiments of the present disclosure provide a cleaning device and a control method thereof, and a computer-readable storage medium. A fluid detection apparatus disposed at least partially outside a fluid output line is used to detect whether there is a fluid in the fluid output line, thereby determining whether there is the fluid capable of meeting a cleaning operation in a fluid storage apparatus. As a cross-sectional area of the fluid output line is smaller, the case that the fluid detection apparatus cannot detect the fluid due to inclination of the cleaning device does not occur. Therefore, whether there is the fluid capable of meeting the cleaning operation in the fluid storage apparatus can be accurately reflected, the accuracy of a detection result is improved, and the structure is simple and easy to assemble.

Figure 1:
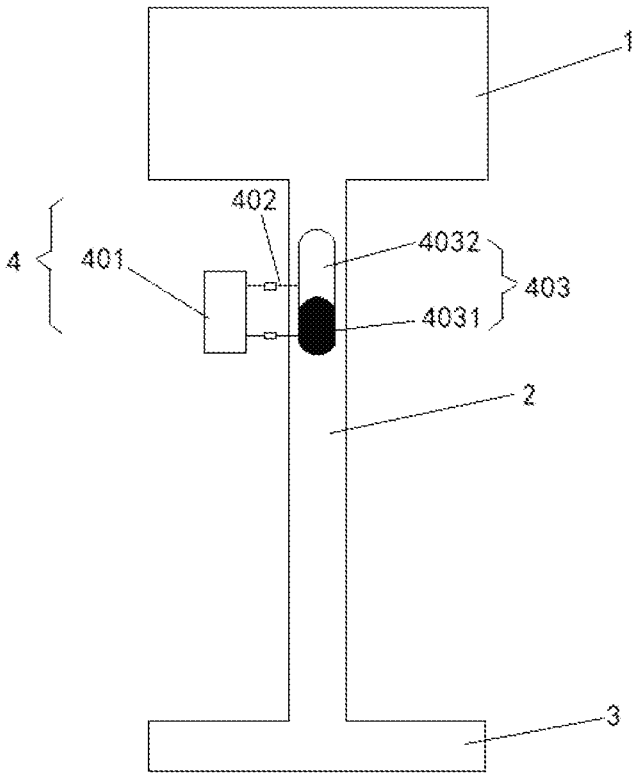
FIG. 1 is a schematic structural diagram of a fluid detection apparatus according to an alternative embodiment of the present disclosure.
Figure 2:
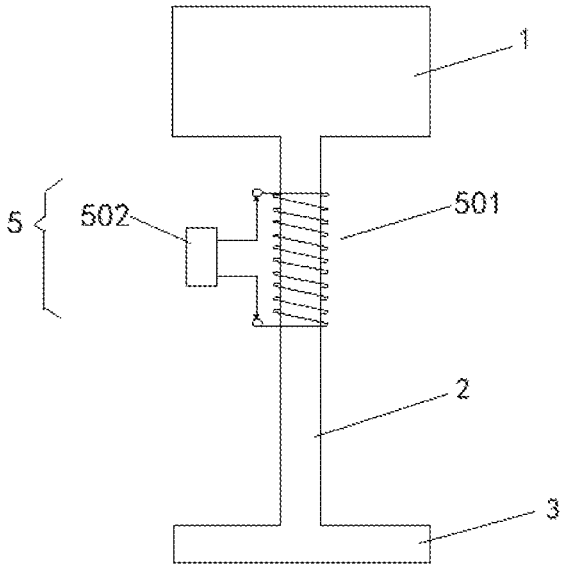
FIG. 2 is a schematic structural diagram of a fluid detection apparatus according to another alternative embodiment of the present disclosure.

In a first aspect, as shown in FIG. 1 and FIG. 2, embodiments of the present disclosure provide a cleaning device. The cleaning device includes a fluid storage apparatus 1 for storing a fluid; a fluid output line 2 communicated with the fluid storage apparatus 1; a fluid detection apparatus, the fluid detection apparatus being at least partially disposed outside the fluid output line 2 and used to detect whether there is a fluid in the fluid output line 2; and a control apparatus, the control apparatus being electrically connected to the fluid detection apparatus and used to output a corresponding control instruction according to a detection result of the fluid detection apparatus, and the detection result including a fluid-present state and a fluid-absent state.

The fluid may be any one of clean water, a cleaning agent, and a mixed solution of the clean water and the cleaning agent. The fluid storage apparatus 1 may be a container capable of accommodating a liquid, and the specific shape is not strictly limited. The fluid output line 2 may be a hard pipe extending according to a path, or a flexible pipe with a changeable path, which may be specifically selected according to the type and the structural design of the cleaning device.

Figure 3:
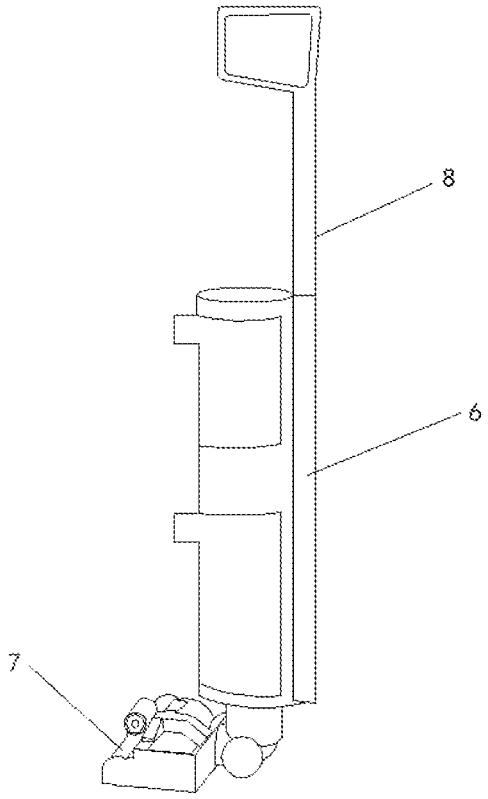
FIG. 3 is an overall view of a cleaning device according to an alternative embodiment of the present disclosure.

In specific application, the cleaning device is a sweeping robot, a mopping robot, a floor polishing robot, a weeding robot or a hand-held cleaning device, but is not limited thereto. In some embodiments, as shown in FIG. 3, by taking the hand-held floor scrubbing device as an example, the hand-held floor scrubbing device further includes a main body 6, a cleaning head 7, a fluid classification apparatus 3, and the like.

The main body 6 is an elongated cylinder with a cavity, and the control apparatus and the fluid storage apparatus 1 and the fluid output line 2 in the embodiment of the present disclosure are configured in the cavity of the main body 6 to reduce the space occupied by the cleaning device. One end of the main body 6 is rotatably connected to the cleaning head 7, and the other end of the main body 6 is provided with a handle 8. When the floor scrubbing robot is used, the whole formed by the handle 8 and the main body 6 is inclined relative to a cleaning member, so that the cleaning member fits more closely a surface to be cleaned by using a downward pressure generated by the gravity of the main body 6, and it is convenient for a user to push the cleaning member by using the handle 8, and effort saving is achieved. When the cleaning device is placed on a charging pile, the whole formed by the handle 8 and the main body 6 is perpendicular to the cleaning member, thereby reducing the space occupied by the hand-held floor scrubbing device.

The cleaning head 7 includes a cleaning head housing and the cleaning member disposed in the housing. The specific form of the cleaning member is not limited, for example, the cleaning member may be a floor scrubbing cloth, a floor scrubbing sponge, or a floor scrubbing roller brush, etc., as long as the cleaning of the surface to be cleaned can be achieved. In addition, a material of the floor scrubbing cloth is not limited, and may be cotton thread cloth, fiber cloth and so on. By taking the floor scrubbing roller brush as an example, the floor scrubbing roller brush includes a roller brush and a driving part connected to the roller brush, the roller brush may be in contact with the surface to be cleaned, and the driving part drives the roller brush to roll.

The fluid classification apparatus 3 may include a plurality of nozzles for spraying a cleaning liquid to the cleaning member, the fluid storage apparatus 1 is communicated with the nozzles through the fluid output line 2, so as to deliver the fluid in the fluid storage apparatus 1 to the nozzles through the fluid output line 2, thereby wetting the cleaning head 7 through the nozzles.

The control apparatus may be implemented by using various application-specific integrated circuits (ASICs), digital signal processors (DSPs), digital signal processing devices (DSPDs), programmable logic devices (PLDs), field programmable gate arrays (FPGAs), micro central controller elements, microprocessors or other electronic elements.

The control apparatus is electrically connected to the fluid detection apparatus, and used to output the corresponding control instruction according to the detection result of the fluid detection apparatus. That is, if the fluid detection apparatus detects that there is the fluid in the fluid output line 2, that is to say, there is still fluid flowing into the fluid output line 2 in the fluid storage apparatus 1, then the control apparatus outputs a control instruction indicating normal working to other apparatuses of the cleaning device based on the detection result, so as to control the cleaning device to perform the cleaning operation normally. If the fluid detection apparatus detects that there is no fluid in the fluid output line 2, that is to say, no fluid in the fluid storage apparatus 1 enters the fluid output line 2, which means that the fluid storage apparatus 1 is completely free of the cleaning liquid, or the fluid of the fluid storage apparatus 1 is not enough to enter the fluid output line 2, then based on the detection result, the control apparatus outputs a control instruction indicating work stopping to other apparatuses of the cleaning device, so as to control the cleaning device to stop working, and the work can only be resumed after the user adds the fluid into the fluid storage apparatus 1. Therefore, the fluid detection apparatus disposed outside the fluid output line 2 is used to detect whether there is the fluid in the fluid output line 2, thereby determining whether there is the fluid capable of meeting the cleaning operation in the fluid storage apparatus 1. A cross-sectional area of the fluid output line 2 is smaller, and a case that the fluid detection apparatus cannot detect the fluid due to inclination of the cleaning device does not occur. Therefore, whether there is the fluid capable of meeting the cleaning operation in the fluid storage apparatus 1 can be accurately reflected, the accuracy of the detection result is improved, and the structure is simple and easy to assemble.

The fluid detection apparatus includes a contact sensor 4 and a non-contact sensor 5. The non-contact sensors 5 may be all located outside the fluid output line 2, while electrodes 403 of the contact sensor 4 need to extend into the fluid output line 2. The above two sensors will be described in detail below.

Further, the cleaning device further includes an alarm apparatus electrically connected to the control apparatus. When the control apparatus determines that the detection result is the fluid-absent state, the control apparatus controls the alarm apparatus to send an alarm signal, so as to remind the user of adding the fluid to the fluid storage apparatus 1. The alarm apparatus includes a multimedia output apparatus electrically connected to the control apparatus, and the multimedia output apparatus is used to give an alarm by means of voice broadcast or display. In some embodiments, the multimedia output apparatus includes at least one of a display screen, a digital display tube, and an audio device.

In some embodiments, the cleaning device is further provided with a fixing part for fixing the fluid detection apparatus to the fluid output line 2.

The fixing part may be a detachable connector, for example, a buckle, etc., so that the detachable connection between the fluid detection apparatus and an outer wall of the fluid output line 2 can be realized, which is convenient for the user to assemble and disassemble.

In specific application, the fluid detection apparatus is a non-contact sensor 5 or a contact sensor 4.

As the fluid moves away from or close to the non-contact sensor 5, the non-contact sensor 5 changes to detect whether there is the fluid in the fluid output line. The non-contact sensor 5 can realize liquid level detection without being in contact with the fluid, which effectively reduces the influence of instability of a liquid level on the detection result, and is beneficial to improving the reliability of the detection result.

Figure 4:
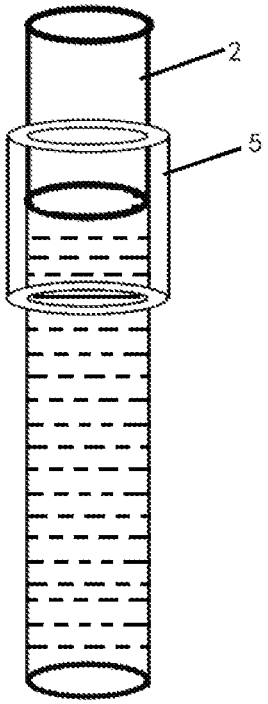
FIG. 4 is a schematic diagram showing a use state of a fluid detection apparatus according to still another alternative embodiment of the present disclosure.

Specifically, as shown in FIG. 2 and FIG. 4, the non-contact sensor 5 is a capacitive sensor. The capacitive sensor includes a sensing part 501 surrounding the fluid output line 2 and a first processing circuit 502 electrically connected to both ends of the sensing part 501. In some embodiments, the sensing part 501 is a spring.

When the capacitive sensor moves away from or close to the fluid, a capacitance of the capacitive detection sensor changes, that is to say, when no fluid approaches, the capacitive sensor has a smaller parasitic capacitance, and when the fluid approaches, the parasitic capacitance changes, and whether there is the fluid in the fluid output line 2 can be detected according to the change of the parasitic capacitance.

In some embodiments, the first processing circuit 502 calculates a difference between a generated real-time sensing capacitance value and an environment sensing capacitance value, wherein the environment sensing signal is a sensing capacitance value generated when there is no fluid in the fluid output line. Then the control apparatus compares the difference with a preset threshold, if the difference is greater than or equal to the preset threshold, it is determined that there is the fluid in the fluid output line 2, so as to determine that the fluid capable of meeting the cleaning operation is stored the fluid storage apparatus 1, and then the control apparatus controls the cleaning device to continue working according to the detection result; and if the difference is less than the preset threshold, it is determined that there is no fluid in the fluid output line 2, so as to determine that there is no fluid capable of meeting the cleaning operation in the fluid storage apparatus 1, and then the control apparatus controls the cleaning device to stop working according to the detection result.

A sensing component of the contact sensor 4 extends into the fluid output line 2, and whether there is the fluid in the output pipeline 2 is determined by detecting whether the fluid is in contact with the sensing component.

As shown in FIG. 1, the contact sensor 4 includes the electrodes 403 and a second processing circuit 401 electrically connected to the electrodes 403, and the electrodes 403 extend into the fluid output line 2. The detection is performed by using the electrodes 403 to be in contact with the fluid. In some embodiments, the electrodes 403 include a positive electrode 4031 and a negative electrode 4032; and the second processing circuit 401 is electrically connected to the positive electrode 4031 and the negative electrode 4032 respectively, and the positive electrode 4031 and the negative electrode 4032 extend into the fluid output line 2. When the electrodes 403 are in contact with the fluid, the positive electrode 4031 and the negative electrode 4032 are brought into conduction through the fluid, and the second processing circuit 401 determines that the fluid storage apparatus 1 has the fluid capable of meeting the cleaning operation, so that the control apparatus controls the cleaning device to continue working. When the electrodes 403 are not in contact with the fluid, the positive electrode 4031 and the negative electrode 4032 are isolated, and the second processing circuit 401 determines that there is no fluid capable of meeting the cleaning operation in the fluid storage apparatus 1, so that the control apparatus controls the cleaning device to stop working.

Further, as shown in FIG. 1, each of the positive electrode 4031 and the negative electrode 4032 includes an electrical conductor 402 and a metal sheet. The metal sheet is located in the fluid output line 2, one end of the electrical conductor 402 is electrically connected to the second processing circuit 401, and the other end of the electrical conductor 402 extends into the fluid to be connected to the metal sheet.

The metal sheet can increase a contact area with the fluid, thereby increasing a detection range of the fluid detection apparatus and enabling the detection result to be more accurate.

In some embodiments, as shown in FIG. 1, the metal sheet takes the shape of an ellipse, and a long axis of the ellipse is set in the same direction as an extending direction of the side wall of the fluid output line 2.

The metal sheet takes the shape of the ellipse, which not only matches the fluid output line 2 in shape, but also greatly increases the contact area between the metal sheet and the fluid. Further, the metal sheet is a copper sheet, thereby reducing corrosion of the fluid to the metal sheet and prolonging a service life of the contact sensor 4.

Figure 5:
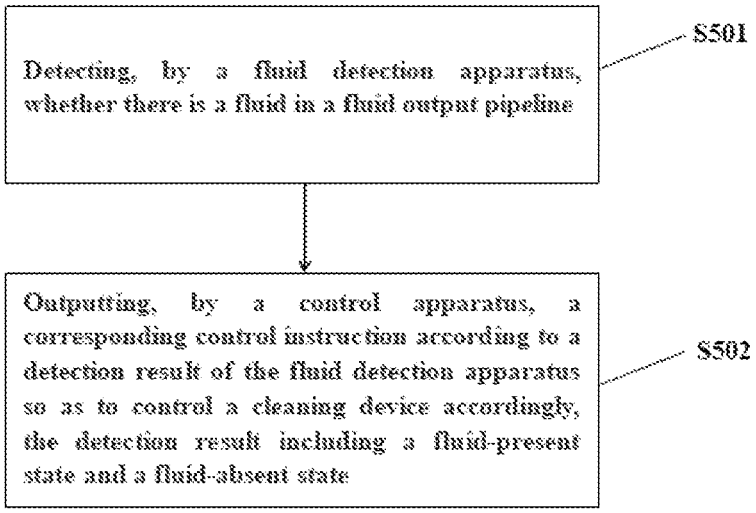
FIG. 5 is a flowchart of a control method of a cleaning device according to another alternative embodiment of the present disclosure.

In a second aspect, embodiments of the present disclosure provide a control method of a cleaning device. The cleaning device includes a fluid storage apparatus, a fluid output line communicated with the fluid storage apparatus, a fluid detection apparatus disposed outside the fluid output line, and a control apparatus electrically connected to the fluid detection apparatus. As shown in FIG. 5, the method includes the following steps.

In step S501, the fluid detection apparatus detects whether there is a fluid in the fluid output line.

In some embodiments, the fluid may be any one of clean water, a cleaning agent, and a mixed solution of the clean water and the cleaning agent. The fluid detection apparatus is a non-contact sensor or a contact sensor.

As the fluid moves away or close to the non-contact sensor 5, the non-contact sensor 5 changes to detect whether there is the fluid in the fluid output line. The non-contact sensor 5 can realize liquid level detection without being in contact with the fluid, which effectively reduces the influence of instability of a liquid level on the detection result, and is beneficial to improving the reliability of the detection result.

Figure 6:
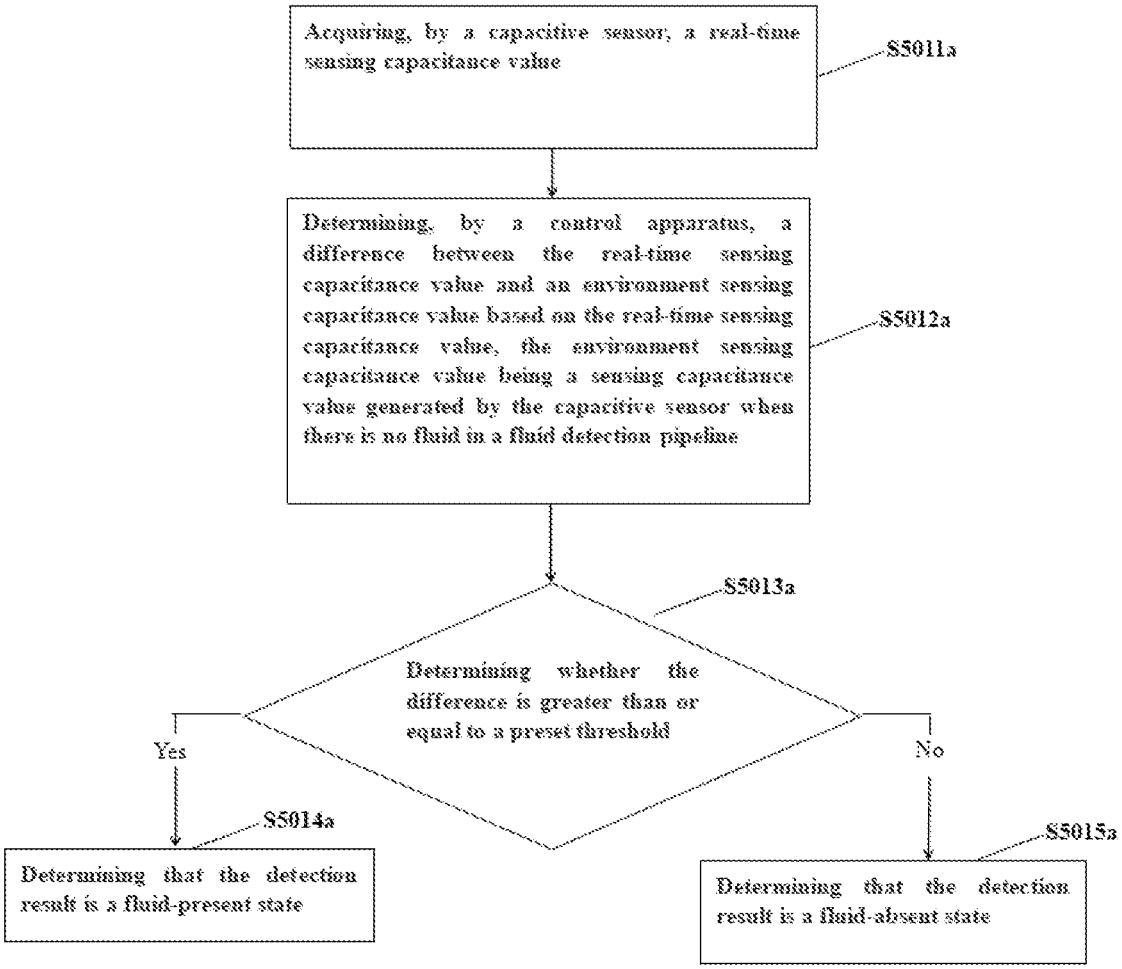
FIG. 6 is a flowchart of step S501 according to an alternative embodiment of the present disclosure.

In the case where the non-contact detection sensor is a capacitive sensor, as shown in FIG. 6, the step specifically includes the following steps.

In step S5011*a*, the capacitive sensor acquires a real-time sensing capacitance value.

In step S5012*a*, based on the real-time sensing capacitance value, the control apparatus determines a difference between the real-time sensing capacitance value and an environment sensing capacitance value. The environment sensing capacitance value is a sensing capacitance value generated by the capacitive sensor when there is no fluid in the fluid detection pipeline.

In step S5013*a*, whether the difference is greater than or equal to a preset threshold is determined, if the difference is greater than or equal to the preset threshold, then step S5014*a* is executed, and if the difference is less than the preset threshold, then step S5015*a* is executed.

In step S5014*a*, it is determined that the detection result is a fluid-present state.

In step S5015*a*, it is determined that the detection result is a fluid-absent state.

When the fluid moves away from or close to the capacitive sensor, a circuit of the capacitive detection sensor changes, that is to say, when no fluid approaches, the capacitive detection sensor has a smaller parasitic capacitance, and when the fluid approaches, the parasitic capacitance changes, and whether there is the fluid in the fluid output line 2 can be detected according to the change of the parasitic capacitance by using the solution of step S5013*a* to step S5015*a*.

Figure 7:
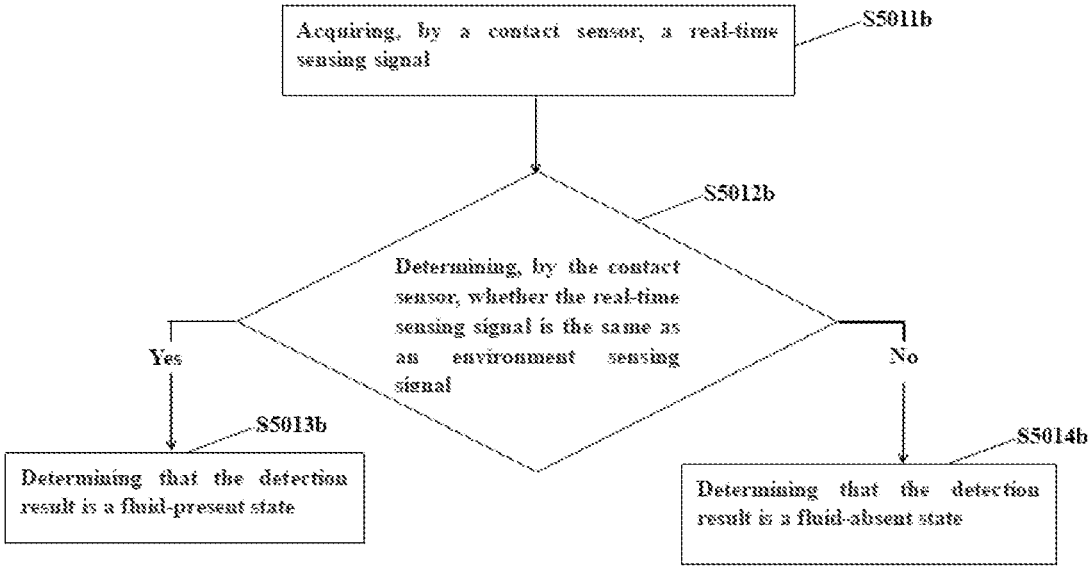
FIG. 7 is a flowchart of step S501 according to another alternative embodiment of the present disclosure.

A sensing component of the contact sensor 4 extends into the fluid output line 2, and whether there is the fluid in the output pipeline 2 is determined by detecting whether the fluid is in contact with the sensing component. In some embodiments, as shown in FIG. 7, this step includes the following steps.

In step S5011*b*, the contact sensor acquires a real-time sensing signal.

In some embodiments, the electrodes 403 include the positive electrode 4031 and the negative electrode 4032; the second processing circuit 401 is electrically connected to the positive electrode 4031 and the negative electrode 4032 respectively, and the positive electrode 4031 and the negative electrode 4032 extend into the fluid output line 2 to generate the real-time sensing signal.

In step S5012*b*, the contact sensor determines whether the real-time sensing signal is the same as an environment sensing signal. If the real-time sensing signal is the same as the environment sensing signal, then step S5013*b* is executed; and if the real-time sensing signal is different from the environment sensing signal, then step S5014*b* is executed. The environment sensing signal is a sensing signal generated when the contact sensor is in contact with the fluid.

In step S5013*b*, that the detection result is the fluid-present state is determined.

In step S5014*b*, that the detection result is the fluid-absent state is determined.

In some embodiments, when the electrodes 403 are in contact with the fluid, the positive electrode 4031 and the negative electrode 4032 are brought into conduction through the fluid, which will generate a sensing signal the same as the environment sensing signal, and the second processing circuit 401 determines that the fluid storage apparatus 1 stores the fluid capable of meeting the cleaning operation. When the electrodes 403 are not in contact with the fluid, the positive electrode 4031 and the negative electrode 4032 are isolated, which will generate a sensing signal different from the environment sensing signal, and the second processing circuit 401 determines that there is no fluid capable of meeting the cleaning operation in the fluid storage apparatus 1, and whether there is the fluid in the fluid output line 2 can be detected by using the solution of step S5012*b* to step S5014*b*.

In step S502, the control apparatus outputs a corresponding control instruction according to the detection result of the fluid detection apparatus, so as to control the cleaning device accordingly, and the detection result includes the fluid-present state and the fluid-absent state.

Further, the cleaning device further includes an alarm apparatus electrically connected to the control apparatus. The alarm apparatus includes a multimedia output apparatus electrically connected to the control apparatus, and the multimedia output apparatus is used to give an alarm by means of voice broadcast or display. In some embodiments, the multimedia output apparatus includes at least one of a display screen, a digital display tube, and an audio device. This step specifically includes the following steps.

In step S5021, when the detection result is the fluid-present state, the control apparatus outputs a first control instruction for controlling the cleaning device to work normally based on the detection result, so that the cleaning device continues working.

It may be understood that when the detection result is the fluid-present state, it indicates that the fluid storage apparatus 1 stores the fluid capable of meeting the cleaning operation, and thus the control apparatus controls the cleaning device to continue working.

In step S5022, when the detection result is the fluid-absent state, the control apparatus outputs a second control instruction for controlling the cleaning device to stop working based on the fluid-absent state, so that the cleaning device stops working; or a third control instruction for controlling the alarm apparatus to activate is output, so that the alarm apparatus gives an alarm.

It may be understood that when the detection result is the fluid-absent state, it indicates that there is no fluid capable of meeting the cleaning operation in the fluid storage apparatus 1, so that the control apparatus controls the cleaning device to stop working, or controls the alarm apparatus to give an alarm, so that the user is reminded of water injection.

For the control method of the cleaning device according to the embodiments of the present disclosure, the fluid detection apparatus disposed outside the fluid output line is used to detect whether there is the fluid in the fluid output line, thereby determining whether there is the fluid capable of meeting the cleaning operation in the fluid storage apparatus. The cross-sectional area of the fluid output line is smaller, and a case that the fluid detection apparatus cannot detect the fluid due to inclination of the cleaning device does not occur. Therefore, whether there is the fluid capable of meeting the cleaning operation in the fluid storage apparatus can be accurately reflected, the accuracy of the detection result is improved, and the fluid detection apparatus is disposed outside the fluid output line, so that the structure is simple and easy to assemble.

In a third aspect, embodiments of the present disclosure provide a computer-readable storage medium storing computer program instructions thereon; and the computer program instructions, when executed by a processor, implement the abovementioned control method of the cleaning device.

It should be noted that the technical solution of the storage medium and the technical solution of the abovementioned control method belong to the same concept, and the details of the technical solution of the storage medium, which are not described in detail, may refer to the description of the technical solution of the abovementioned method. The computer instructions include computer program codes, which may be in a source code form, an object code form, an executable file, some intermediate forms, or the like. The computer-readable medium may include any entity or apparatus capable of carrying the computer program codes, a recording medium, a U disk, a mobile hard disk, a magnetic disk, an optical disk, a computer memory, a read-only memory (ROM), a random-access memory (RAM), an electric carrier signal, a telecommunication signal, a software distribution medium and the like.

Embodiments of the present disclosure provide a cleaning device, including:

a fluid storage apparatus for storing a fluid;

a fluid output line communicated with the fluid storage apparatus;

a fluid detection apparatus, the fluid detection apparatus being disposed at least partially outside the fluid output line and being used for detecting whether there is a fluid in the fluid output line; and a control apparatus, the control apparatus being electrically connected to the fluid detection apparatus, and used for outputting a corresponding control instruction according to a detection result of the fluid detection apparatus, and the detection result including a fluid-present state and a fluid-absent state.

In some embodiments, the cleaning device is further provided with a fixing part for fixing the fluid detection apparatus to the fluid output line.

In some embodiments, the fluid detection apparatus is a non-contact sensor or a contact sensor.

In some embodiments, the non-contact sensor is a capacitive sensor.

In some embodiments, the capacitive sensor includes a sensing part surrounding the fluid output line and a first processing circuit electrically connected to both ends of the sensing part.

In some embodiments, the sensing part is a spring. In some embodiments, the contact sensor includes electrodes and a second processing circuit electrically connected to the electrodes, the electrodes extending into the fluid output line.

In some embodiments, the electrodes include a positive electrode and a negative electrode; the second processing circuit is electrically connected to the positive electrode and the negative electrode respectively, and the positive electrode and the negative electrode extend into the fluid output line.

In some embodiments, the cleaning device further includes an alarm apparatus electrically connected to the control apparatus, and when the control apparatus determines that the detection result is the fluid-absent state, the control apparatus controls the alarm apparatus to send an alarm signal.

Embodiments of the present disclosure provide a control method of a cleaning device. The cleaning device includes a fluid storage apparatus, a fluid output line communicated with the fluid storage apparatus, a fluid detection apparatus disposed outside the fluid output line, and a control apparatus electrically connected to the fluid detection apparatus. The method includes:

detecting, by the fluid detection apparatus, whether there is a fluid in the fluid output line; and outputting, by the control apparatus, a corresponding control instruction according to a detection result of the fluid detection apparatus, so as to control the cleaning device accordingly, the detection result including a fluid-present state and a fluid-absent state.

In some embodiments, the fluid detection apparatus is a non-contact sensor, and in the case where the non-contact detection sensor is a capacitive sensor, detecting, by the fluid detection apparatus, whether there is the fluid in the fluid output line includes:

acquiring, by the capacitive sensor, a real-time sensing capacitance value; and determining, by the capacitive sensor, a difference between the real-time sensing capacitance value and an environment sensing capacitance value based on the real-time sensing capacitance value, the environment sensing capacitance value being a sensing capacitance value generated by the capacitive sensor when there is no fluid in the fluid detection pipeline; and determining whether the difference is greater than or equal to a preset threshold, and if the difference is greater than or equal to the preset threshold, determining that the detection result is the fluid-present state; and if the difference is less than the preset threshold, determining that the detection result is the fluid-absent state.

In some embodiments, the fluid detection apparatus is a contact sensor, and detecting, by the fluid detection apparatus, whether there is the fluid in the fluid output line includes:

acquiring, by the contact sensor, a real-time sensing signal; and determining, by the contact sensor, whether the real-time sensing signal is the same as an environment sensing signal, if the real-time sensing signal is the same as the environment sensing signal, determining, by the contact sensor, that the detection result is the fluid-present state, and if the real-time sensing signal is different from the environment sensing signal, determining, by the contact sensor, that the detection result is the fluid-absent state, wherein the environment sensing signal is a sensing signal generated by the contact sensor when the contact sensor is in contact with the fluid.

In some embodiments, the cleaning device further includes an alarm apparatus electrically connected to the control apparatus, and outputting, by the control apparatus, the corresponding control instruction according to the detection result of the fluid detection apparatus, so as to control the cleaning device accordingly includes:

outputting, by the control apparatus, a first control instruction for controlling the cleaning device to work normally based on the fluid-present state when the detection result is the fluid-present state, so that the cleaning device continues working; and outputting, by the control apparatus, a second control instruction for controlling the cleaning device to stop working based on the fluid-absent state when the detection result is the fluid-absent state, so that the cleaning device stops working, or outputting, by the control apparatus, a third control instruction for controlling the alarm apparatus to activate based on the fluid-absent state when the detection result is the fluid-absent state, so that the alarm apparatus give an alarm.

The present disclosure has been described by the abovementioned embodiments, but it should be understood that the abovementioned embodiments are only for the purpose of illustration and description, and are not intended to limit the present disclosure to the scope of the described embodiments. In addition, it may be understood by those skilled in the art that the present disclosure is not limited to the abovementioned embodiments, more variations and modifications may be made according to teachings of the present disclosure, these variations and modifications all fall within the scope of protection claimed in the present disclosure. The scope of protection of the present disclosure is defined by the appended claims and equivalents thereof.

What is claimed is:

1. A cleaning device, comprising:

a fluid storage apparatus, configured to store a fluid;

a fluid output line, in communication with the fluid storage apparatus;

a fluid detection apparatus, disposed at least partially outside the fluid output line, and configured to detect whether the fluid is in the fluid output line, wherein the fluid detection apparatus is a non-contact sensor or a contact sensor, the non-contact sensor is a capacitive sensor, the capacitive sensor comprises a sensing part surrounding the fluid output line and a first processing circuit electrically connected to both ends of the sensing part, the sensing part is a spring, and wherein the contact sensor comprises an electrode and a second processing circuit electrically connected to the electrode, the electrode comprises a positive electrode and a negative electrode, the second processing circuit is electrically connected to the positive electrode and the negative electrode, respectively, and the positive electrode and the negative electrode are extended into the fluid output line, each of the positive electrode and the negative electrode comprises an electrical conductor and a metal sheet, the metal sheet is located in the fluid output line, one end of the electrical conductor is electrically connected to the second processing circuit, and the other end of the electrical conductor is extended into the fluid to be connected to the metal sheet, and a shape of the metal sheet is an ellipse matching a shape of the fluid output line, and a long axis of the ellipse is set in the same direction as an extending direction of a side wall of the fluid output line; and a control apparatus, electrically connected to the fluid detection apparatus, and configured to output a corresponding control instruction according to a detection result of the fluid detection apparatus, wherein the detection result comprises a fluid-present state and a fluid-absent state, wherein the cleaning device is further provided with a fixing part configured to fix the fluid detection apparatus to the fluid output line, and the fixing part is a detachable connector.

2. The cleaning device according to claim 1, wherein the cleaning device further comprises an alarm apparatus electrically connected to the control apparatus, and when the detection result determined by the control apparatus is the fluid-absent state, the alarm apparatus is controlled by the control apparatus to give an alarm signal.

3. The cleaning device according to claim 2, wherein the alarm apparatus comprises a multimedia output apparatus electrically connected to the control apparatus.

* * * * *